US005556566A

United States Patent [19]

Cappello et al.

[11] Patent Number: 5,556,566

[45] Date of Patent: Sep. 17, 1996

[54] COMBINED GAS-MICROWAVE COOKING OVEN WITH STEAM OPERATION

[75] Inventors: Massimo Cappello, Venice; Claudio Marchesin, Pordenone, both of Italy

[73] Assignee: Zanussi Grandi Impianti S.p.A., Pordenone, Italy

[21] Appl. No.: 456,766

[22] Filed: Jun. 1, 1995

[30] Foreign Application Priority Data

Jun. 22, 1994 [IT] Italy ..... PN94A0041

[51] Int. Cl.[6] ..... H05B 6/64; F24C 1/02

[52] U.S. Cl. ..... 219/683; 219/682; 219/401; 126/21 A; 99/451

[58] Field of Search ..... 219/681, 682, 219/683, 738, 400, 401; 126/20, 21 R, 21 A, 369; 99/467, 473, 474, 451

[56] References Cited

U.S. PATENT DOCUMENTS

| | | | |
|---|---|---|---|
| 2,595,748 | 5/1952 | Andrews | 219/716 |
| 3,450,487 | 6/1969 | Wallden | 219/401 |
| 3,789,178 | 1/1974 | Harhen | 219/682 |
| 3,961,568 | 6/1976 | Jeppson | 219/682 |
| 4,154,861 | 5/1979 | Smith | 219/681 |
| 4,281,636 | 8/1981 | Vegh et al. | 126/369 |
| 5,166,487 | 11/1992 | Hurley et al. | 219/681 |

FOREIGN PATENT DOCUMENTS

| | | |
|---|---|---|
| 0349213 | 6/1989 | European Pat. Off. . |
| 2179529 | 7/1986 | United Kingdom . |

*Primary Examiner*—Philip H. Leung
*Attorney, Agent, or Firm*—Pearne, Gordon, McCoy & Granger

[57] ABSTRACT

A microwave oven is combined with gas heating, particularly for cooking foods for groups. The oven includes a cooking chamber, one or more magnetrons for the generation of microwaves, and several hollow heating elements arranged internally or on the walls of this chamber. The oven may also be provided with a conduit for the introduction of steam from an external boiler, in which products of the combustion of inflammable gases pass through these heating elements (5), and their interiors are not in communication with the interior of the chamber. These heating elements consist of essentially vertical tubes that at least partially cross this cooking chamber. The upper ends (11) of the gas exhausts of these heating elements (5) are closed by a box element (12), which is hermetically sealed to microwaves against the upper surface of the top (9) and has at least one hole (14). A corresponding second tube (15) is attached to edges of the hole and defines a microwave trap.

10 Claims, 5 Drawing Sheets

COMBINED GAS-MICROWAVE COOKING OVEN WITH STEAM OPERATION

BACKGROUND OF THE INVENTION

The invention concerns a combined oven for cooking foods suitable for either microwave cooking, cooking by heating the chamber by means of combustion of inflammable gases, or cooking by means of a simultaneous combination of these cooking processes to create particular conditions and cooking effects on foods. These processes can coexist and function also in the presence of a process called "steam cooking" that is, with the injection of water vapor into the cooking chamber.

In the course of this description, particular reference will be made to a cooking oven for cooking food for large groups of people, but what is described and claimed here applies to all kinds of ovens for cooking food, as long as they are provided with gas heating and use microwaves. It is known that oven cooking of food takes on very diverse forms according to the results and effects that one desires to obtain. Among the most preferred methods are microwave cooking and heating by means of combustion, external to the cooking chamber, of inflammable gases and subsequent heat exchange with the interior of the chamber. The peculiarities of these diverse methods of cooking, from the view points of speed, cleaning, safety, energy consumption, and uniformity, are well known and will not be mentioned here.

To summarize the advantages of these two methods, various types of combined gas-microwave ovens have been disclosed, but they have some inconveniences in construction and use, as will be explained in the following.

Combined microwave and gas-combustion ovens are known from patents U.S. Pat. Nos. 4,431,889 and 4,430,541, in which a gas burner positioned outside the cooking chamber generates hot combustion products that are aspirated from the combustion zone by a ventilator. The ventilator pushes these products into the cooking chamber through suitable openings in the chamber walls. Both the exit and entrance openings of the cooking chamber have dimensions substantially less than half the wavelength of the microwaves. Circulation of heated gases inside the cooking chamber is such as to assure substantial uniformity in the circulation of the heated gases.

A combined gas-microwave oven is also known from U.S. Pat. No. 4,211,909, in which separate cooking by gas-combustion heating or by microwave is possible, in order to emphasize particular aspects of cooking performance. In an oven of this kind, the gas burner is placed outside the cooking chamber and the combustion products are made to circulate by a ventilator inside the cooking chamber.

Another combined gas and microwave oven is known from European patent (application) no. 0,349,213, in which it is possible to accelerate the time of heating of the oven by means of simultaneous activation of the two different cooking methods. This oven has a gas burner placed outside the cooking chamber and a ventilator that makes the hot combustion gases circulate forcefully within the chamber. From the functional point of view, there is not much difference from the ovens described previously.

A different combined gas and microwave oven is known from patent GB 2179529 (appl.), in which one or more burners are placed outside the cooking chamber. The passage of gas into the chamber occurs without the aid of ventilators and by means of perforated box elements. The box elements prevent the escape of microwaves from the chamber in one direction. In the other direction, the box elements prevent dirtying of the burner with residues emitted by the foods.

All these types of ovens are effective when limited only to combined microwave cooking and cooking by combustion heating of gases. However, present needs, felt particularly in cooking ovens for food for groups, suggest that it would be desirable to perform the methods of gas and microwave cooking in the same cooking chamber simultaneously with a so-called "steam-cooking" method. Steam cooking is well known to experts in the field and consists of introducing a flow of saturated steam into the cooking chamber at a high temperature. In order to be efficient, this method requires that the steam fill the cooking chamber and envelop the food in an atmosphere of saturated steam at a high temperature. This type of cooking is particularly in demand because of such characteristics as speed and economy. However, the presence of saturated water vapor requires that the chamber be essentially hermetically sealed, even if not under pressure. This fact is totally incompatible with the admission of oxygen and combustion gases from outside the chamber. The combustion products should also be emitted to the outside environment. For this reason, none of the ovens described above is compatible with "steam" operation.

SUMMARY OF THE INVENTION

The present invention provides an oven particularly for cooking food for large groups, suitable for performing, both in an independent mode and in combined mode, microwave cooking, gas-combustion heating, and steam cooking, the construction of which is simple and reliable and is realizable with normally available techniques.

The present invention proposes to improve construction of cooking ovens with characteristics substantially as described, with particular reference to the attached claims.

BRIEF DESCRIPTION OF THE DRAWINGS

The invention will be understood better by the attached claims and the following description, which is given only by way of non-limiting example, and by reference to the attached diagrams, in which:

DETAILED DESCRIPTION OF THE PREFERRED EMBODIMENTS

Figure 1:
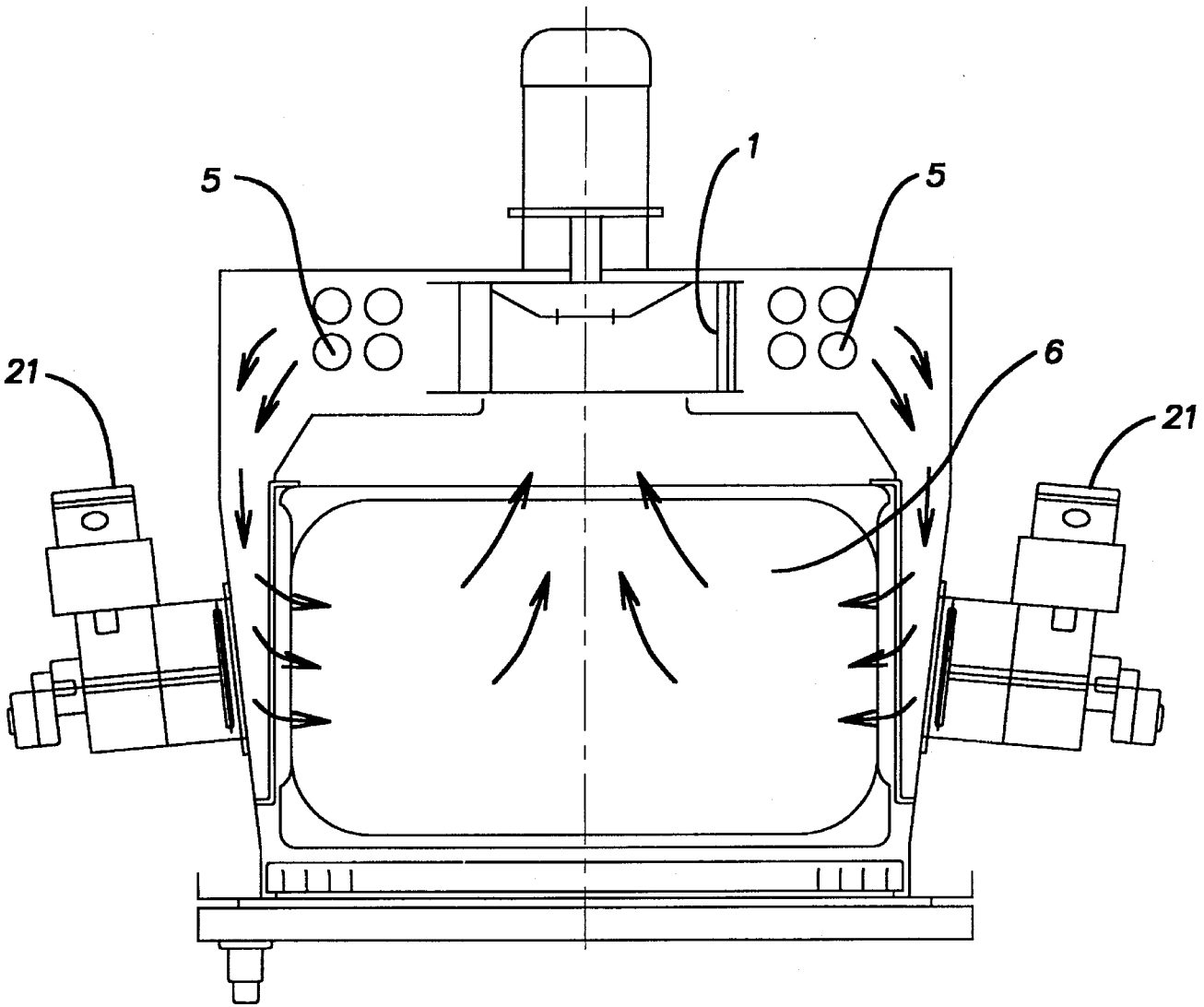
FIG. 1 shows schematically a horizontal section at mid-height through a cooking oven according to the invention.

With reference to FIG. 1, the inside of a cooking chamber for food is shown. A motorized ventilator 1 is placed at the rear or bottom of this cooking chamber and suitable devices, such as a magnetron 21, are provided for the generation and propagation of microwaves inside this chamber. The microwave devices can be of the type described in European patent (appl.) no. 90119715 by the same applicant.

Figure 2:
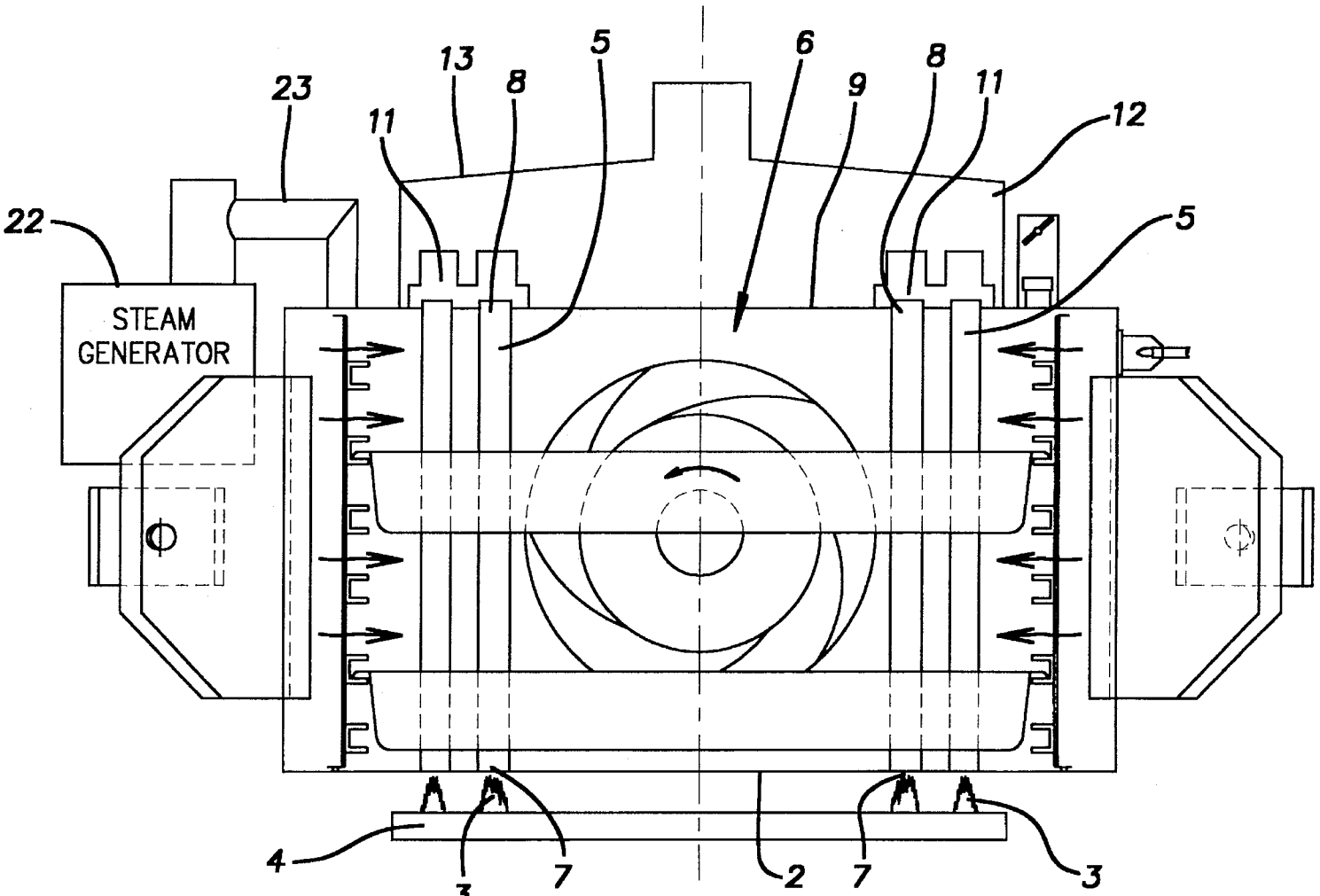
FIG. 2 shows a transverse vertical section of the oven of FIG. 1.

Referring to FIG. 2, a steam generator 22 or boiler is provided with a conduit 23 adapted for transferring steam to the chamber.

Under a lower plane 2 or a base of the chamber, are placed one or more burners 3 of the traditional type, fed by a suitable conduit 4 for the introduction of gas. Above these burners are corresponding vertical first tubes 5 which enter the cooking chamber 6 through suitable holes 7 made in the base. The tubes exit the cooking chamber through corresponding holes 8 made in a top 9 thereof. These tubes end a little above these holes in the top. The junction zone between these tubes and the base is hermetically sealed, preferable by means of welding.

Figure 3:
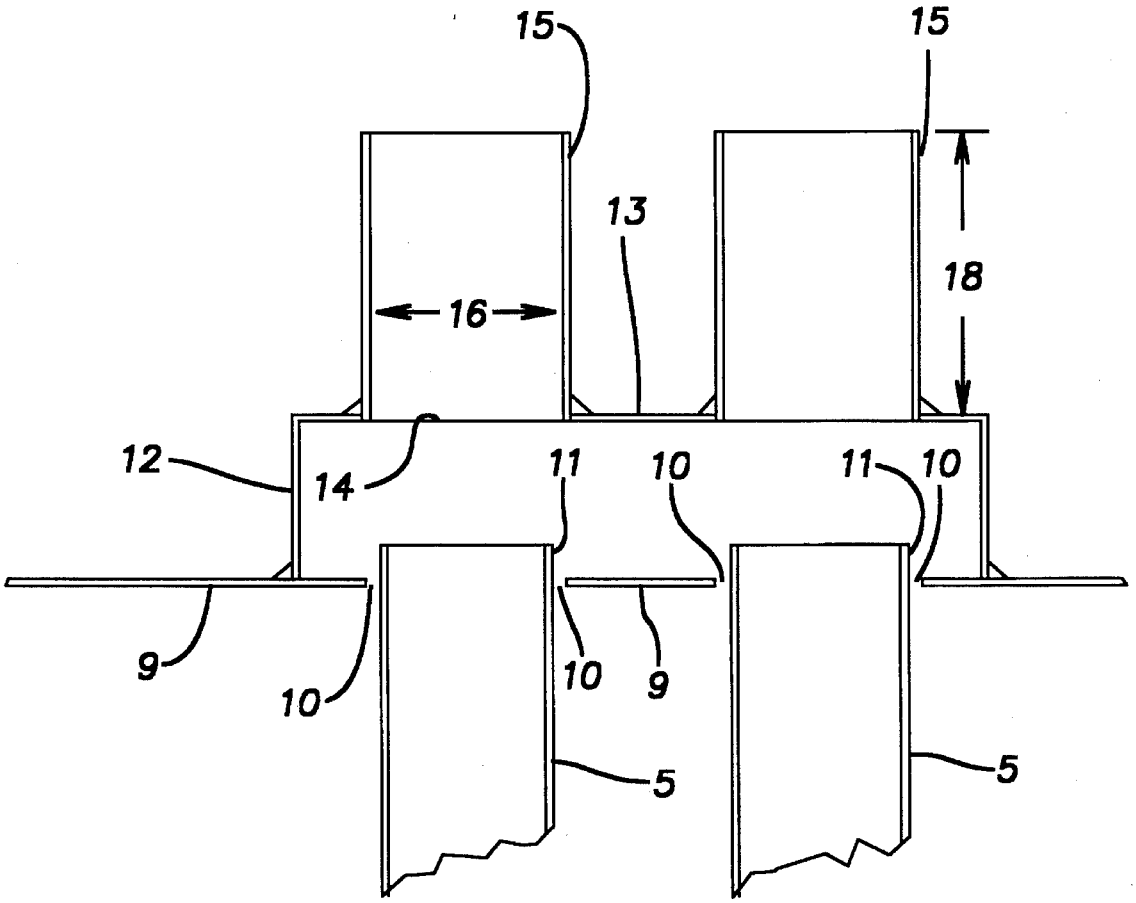
FIG. 3 shows a detailed view of a top portion of the oven of FIG. 2.

Referring to FIG. 3, a ring-shaped junction zone 10 between these tubes and the top 9 of the cooking chamber is open to permit thermal expansion of these tubes to allow lengthening in height without deforming and/or subjecting this junction zone 10 to unwanted forces. Although the inside of the cooking chamber is involved in the propagation of the microwaves, the microwaves tend to escape from these ring-shaped zones, creating well-known problems connected with the escape of microwaves. To eliminate these problems, upper ends 11 of the gas exhausts of these open tubes and ring-shaped zones 10 are closed by a box element 12, which is sealed against the upper surface of this top 9 to prevent escape of microwaves. An upper side 13 of this box element is opened by at least one hole 14. A corresponding second vertical tube 15 is closed with edges of this hole 14 in such a way that microwaves cannot escape. A transverse dimension 16 of these vertical tubes 15 should be less than, and their minimum height 18 should be greater than, ¼ the length of the microwaves.

This device heats by heat exchange between combustion gases and the inside of the cooking chamber. The first tubes 5 can expand under the effect of increasing temperature without compromising the integrity of the top. The gases can freely be evacuated, passing from these tubes to the interior zone of this box element 12 and from there to the exterior through the second vertical shaped tubes 15. The possible escape of microwaves through the open ring-shaped zones located between these first tubes and this top is blocked by the dimensional characteristics of these second tubes, which exit from this box element.

Figure 5:
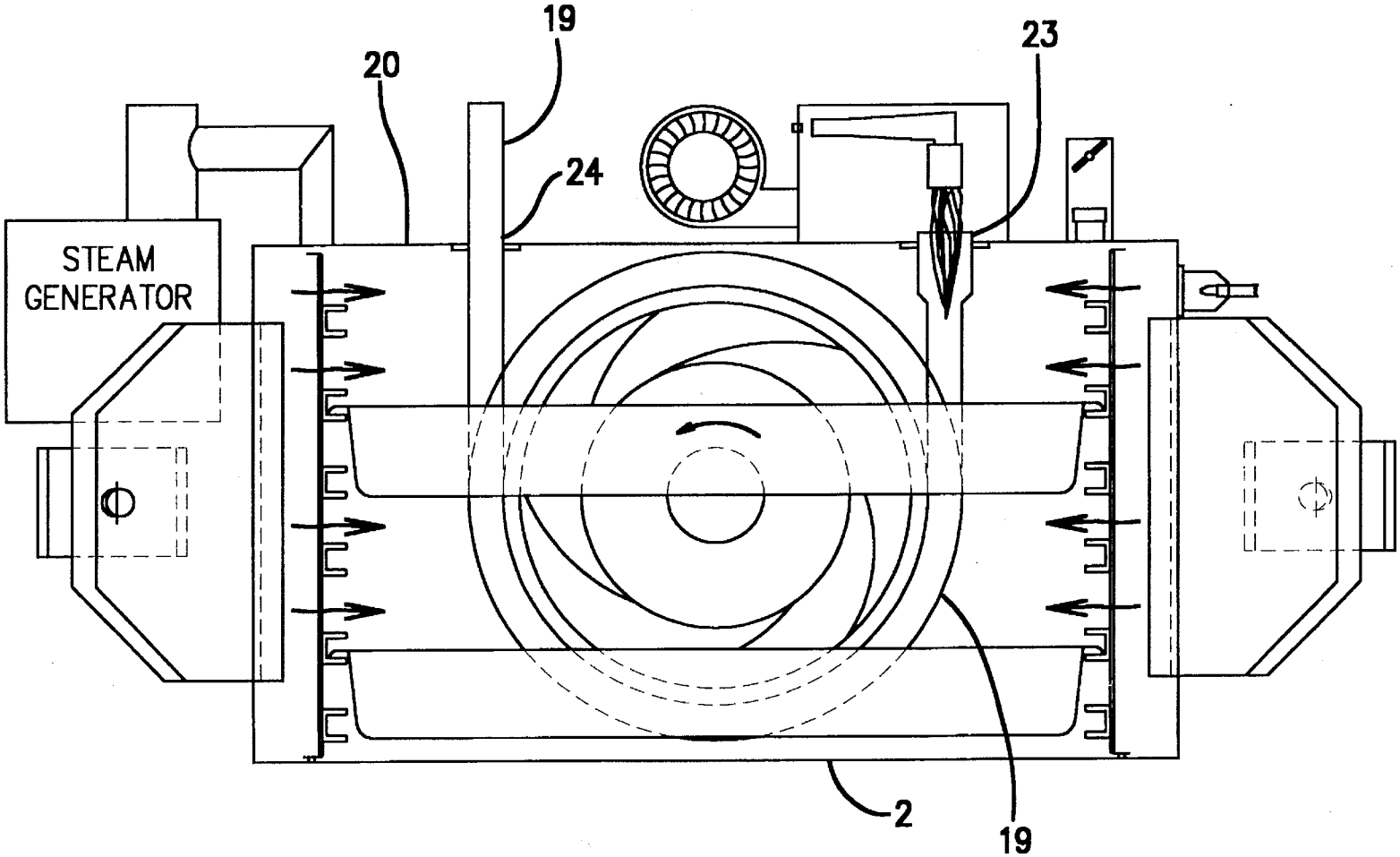
FIG. 5 shows a variant of the oven of FIG. 1.

Referring to FIG. 5, simplified variant of this construction consists of producing these burners and these tubes in such a way that the multiple direct vertical tubes 5 are replaced by a single spiral tube 19. The entrance and exit ends (23,24) for the combustion gas are placed on one side wall 20 of the chamber, as also illustrated in the previous Italian patent (application) no. PN1A000054. The zones of passage of this spiral tube from one part to the other of the wall are sealed to microwaves, e.g. by means of welding and/or flanging.

This configuration is especially advantageous, because the expansion of the spiral tube can be absorbed by the same spiral form without exerting a force on the zone of intersection between the oven walls. Thus, it is possible and useful to avoid construction of the box element described above and to obtain at the same time free evacuation of gas while avoiding all risk of escape of microwaves.

Microwave ovens are normally illuminated by one or more interior lamps, which are normally mounted within an interior wall that delimits the cooking chamber. This involves the inconvenience that when it is necessary to work on the lamp, a good part of the oven has to be disassembled, as any expert in the field knows well.

This problem is more serious if the oven is a combined gas-microwave oven, e.g. of the type described, because its greater complexity and delicacy make the work that much more complicated and demanding.

Figure 4:
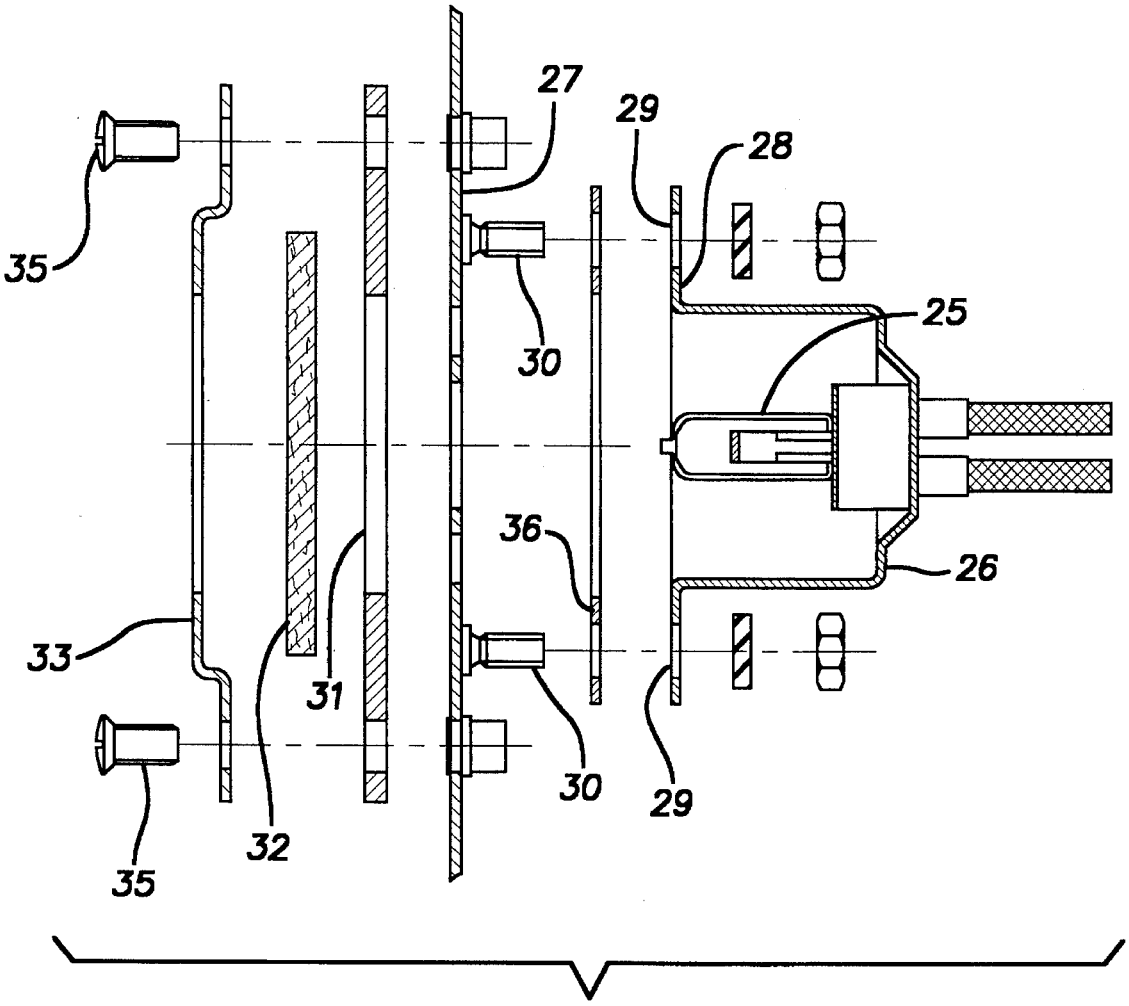
FIG. 4 shows a detailed view of a lamp holder of the oven according to the invention.

Referring to FIG. 4, to avoid this problem of working on the oven, a lamp-holding device is proposed in which a lamp 25 is held in a lamp holder 26 external to the chamber, but adjacent to an inner wall 27 of the chamber, in such a way that it is possible to work on the lamp by working inside the chamber and removing some simple components, without involving the structure of the oven in any way.

As shown in FIG. 4, this lamp holder is provided with a peripheral flange 28 that parallels the wall 27 of the chamber. The flange is provided with several holes 29 that are suitable for receiving corresponding prongs 30 projecting from an exterior surface of the wall of the chamber. The wall is provided in a central zone with at least one hole 31 suitable for the passage of light produced by this lamp into the inside the chamber through the hole. The hole is closed by a transparent, rigid element 32, which is locked to this wall by a bracket 33 suitable to be attached to this wall.

At least one elastic gasket 34 is preferably placed between the surface of the wall facing the inside of the chamber and said transparent element 32, in such a way as to impede the escape of steam and also to reduce the danger that the pressure of the bracket against this transparent element might break the element which is usually made of glass.

Two methods are envisioned to avoid the escape of microwaves throughout this lamp holder. The first consists of the fact that a niche for the lamp holder is formed from a completely closed metal cavity. The second is due to the fact that a gasket 36 is applied between the flange 28 and the corresponding wall 27 of the chamber. The gasket 26 is preferably a metallic screen with a very fine mesh.

At this point, the operation of the device will be clear. In order to work on the lamp, it will be sufficient to remove locking elements 35, for example some screws, that hold the bracket in place, remove this bracket, the glass under it, and any associated gaskets. In order to be able to gain access to the lamp-holder niche directly through the hole 31 and then to the lamp, one need only work inside the cavity, without doing anything to the structure of the oven.

The oven is naturally provided with many other devices that have been omitted here as not relevant to the purposes of this patent. Although the invention has been described by means of the example of the preferred embodiment and with generally known terminology, it is not considered to be limited this, because experts in the field can apply many variations and modifications in construction and shape.

What is claimed is:

1. A combined microwave and gas-heating oven, comprising a cooking chamber (6); one or more magnetrons for generation of microwaves; several hollow heating elements (5) arranged within the chamber; an external boiler; and a conduit (23) in communication between the boiler and an interior of the chamber suitable for feeding steam from the external boiler into the interior of the cooking chamber, characterized by the fact that the heating elements (5) comprise essentially vertical tubes that cross the cooking chamber from a base to a top thereof, thereby allowing products of combustion of inflammable gases to pass through the heating elements (5) and that insides of the heating elements are not in gaseous communication with the interior of the cooking chamber.

2. A combined oven according claim 1, characterized by the fact that one or more burners (3) for inflammable gas are placed under a base of the chamber below lower openings of the hollow heating elements (5); and the heating elements enter the cooking chamber (6) through suitable holes (7) made in the base (2) and leave through corresponding holes (8) made in a top (9) of the chamber.

3. A combined oven according to claim 2, characterized by the fact that tops of these hollow heating elements protrude slightly above the holes (8) made in the top of the cooking chamber.

4. A combined oven according to claim 3 characterized by the fact that an upper end (11) of a gas exhaust of the heating elements (5) and open junction zones (10) between the heating elements and a top are closed by a box element (12), said box element being sealed against microwaves at an upper surface of the top (9); an upper side (13) of the box element is open by at least one hole (14); a vertical tube (15) extends from the hole (14); a transverse dimension (16) of the vertical tube (15) is less than ¼ of a wavelength of the microwaves; and a minimum height of the tube is greater than ¼ of the wavelength of the microwaves.

5. A combined oven according to claim 2, characterized by the fact that a junction zone between these hollow heating elements and the base is hermetically sealed and that a junction zone (10) between the hollow heating elements (5) and the top (9) of the cooking chamber is open and suitable to permit vertical expansion of the heating elements.

6. A combined oven according to claim 5 characterized by the fact that an upper end (11) of a gas exhaust of the heating elements (5) and the open junction zones (10) between the heating elements and the top are closed by a box element (12), said box element being sealed against microwaves at an upper surface of the top (9); an upper side (13) of the box element is open by at least one hole (14); a vertical tube (15) extends from the hole (14); a transverse dimension (16) of the vertical tube (15) is less than ¼ of a wavelength of the microwaves; and a minimum height of the tube is greater than ¼ of the wavelength of the microwaves.

7. A combined oven according to claim 2 characterized by the fact that an upper end (11) of a gas exhaust of the heating elements (5) and open junction zones (10) between the heating elements and a top are closed by a box element (12), said box element being sealed against microwaves at an upper surface of the top (9); an upper side (13) of the box element is open by at least one hole (14); a vertical tube (15) extends from the hole (14); a transverse dimension (16) of the vertical tube (15) is less than ¼ of a wavelength of the microwaves; and a minimum height of the tube is greater than ¼ of the wavelength of the microwaves.

8. A combined oven according to claim 1, characterized by the fact that an upper end (11) of a gas exhaust of the heating elements (5) and open junction zones (10) between the heating elements and a top are closed by a box element (12), said box element being sealed against microwaves at an upper surface of the top (9); an upper side (13) of the box element is open by at least one hole (14); a vertical tube (15) extends from the hole (14); a transverse dimension (16) of the vertical tube (15) is less than ¼ of a wavelength of the microwaves; and a minimum height of the tube is greater than ¼ of the wavelength of the microwaves.

9. A combined microwave and gas-heating oven comprising a cooking chamber (6); one or more magnetrons for generation of microwaves; several hollow heating elements (5) arranged within the chamber; an external boiler; and a conduit (23) in communication between the boiler and an interior of the chamber suitable for feeding steam from the external boiler into the interior of the cooking chamber, characterized by the fact that these hollow heating elements (5) comprise one or more Spiral tubes (19), entrance and exit ends (23, 24) of this spiral are located at one or more walls (20) of the chamber; and a zone where the spiral tube (19) passes from one side to the other of the wall (20) is sealed against microwaves.

10. A combined oven according to claim 8, characterized by the fact that an end (11) of a gas exhaust of the heating elements (5) and open junction zones (10) between the heating elements and the wall are closed by a box element (12), said box element being sealed against microwaves at an outer surface of the wall (20); of the box element is open by at least one hole (14); a tube (15) extends from the hole (14); a transverse dimension (16) of the tube (15) is less than ¼ of a wavelength of the microwaves; and a minimum length of the tube is greater than ¼ of the wavelength of the microwaves.

* * * * *